US005100372A

United States Patent [19]

Headley

[11] Patent Number: 5,100,372

[45] Date of Patent: Mar. 31, 1992

[54] CORE FOR BLOOD PROCESSING APPARATUS

[75] Inventor: Thomas D. Headley, Wellesley, Mass.

[73] Assignee: Haemonetics Corporation, Braintree, Mass.

[21] Appl. No.: 769,476

[22] Filed: Oct. 1, 1991

Related U.S. Application Data

[63] Continuation of Ser. No. 487,643, Mar. 2, 1990, abandoned.

[51] Int. Cl.[5] ..... B04B 7/02

[52] U.S. Cl. ..... 494/41; 494/38; 494/64

[58] Field of Search ..... 494/35, 37, 38, 41, 494/48, 60, 64, 65; 604/4, 6

[56] References Cited

U.S. PATENT DOCUMENTS

| | | | |
|---|---|---|---|
| 3,145,713 | 8/1964 | Latham, Jr. | 494/41 X |
| 3,489,145 | 1/1970 | Judson et al. | 494/38 X |
| 3,498,531 | 3/1970 | Chervenka et al. | 494/38 X |
| 3,519,201 | 7/1970 | Eisel et al. | 494/41 X |
| 3,899,128 | 8/1975 | Joyce | 494/38 X |
| 4,300,717 | 11/1981 | Latham, Jr. . | |
| 4,784,633 | 11/1988 | Bruning et al. | 494/41 |
| 4,882,094 | 11/1989 | Rubin et al. | 494/41 X |
| 4,943,273 | 7/1990 | Pages | 494/41 |
| 4,944,883 | 7/1990 | Schoendorfer et al. | 494/35 X |

OTHER PUBLICATIONS

Haemonetics Corporation Drawing #15963, Core Plasma Bowl 6/23/88.

*Primary Examiner*—Harvey C. Hornsby
*Assistant Examiner*—Stephen F. Gerrity
*Attorney, Agent, or Firm*—Hamilton, Brook, Smith & Reynolds

[57] ABSTRACT

An improved core member for a centrifuge bowl is described in which a plurality of small size circular openings are formed in the core member between a toroidal blood cell separation chamber and a collection chamber to provide fluid communication therebetween for collection of blood component in one flow direction and removal of stains in an opposite flow direction.

10 Claims, 2 Drawing Sheets

CORE FOR BLOOD PROCESSING APPARATUS

This is a continuation of co-pending application Ser. No. 07/487,643 filed on Mar. 2, 1990 (abandoned).

DESCRIPTION

1. Field of the Invention

This invention relates to the field of blood processing.

2. Background of the Invention

Whole human blood includes at least three types of specialized cells. These are red blood cells, white blood cells, and platelets. All of these cells are suspended in plasma, a complex aqueous solution of proteins and other chemicals.

Until relatively recently, blood transfusions have been given using whole blood. There is, however, growing acceptance within the medical profession for transfusing only those blood components required by a particular patient instead of using a transfusion of whole blood. Transfusing only those blood components necessary preserves the available supply of blood, and in many cases, is better for the patient. Before blood component transfusions can be widely employed, however, satisfactory blood separation techniques and apparatus must evolve.

Plasmapheresis is the process of taking whole blood from a donor and separating the whole blood into a plasma component and a non-plasma component under conditions whereby the plasma component is retained and the non-plasma component is returned to the donor.

Thrombocytapheresis is similar, except that whole blood is separated into a platelet component and non-platelet component with the platelet component retained or "harvested" and the non-platelet component returned to the donor.

A particularly useful device for the collection of blood cell components is the Haemonetics R 30 Cell Separator Blood Processor manufactured by Haemonetics Corporation, Braintree, Mass. (hereinafter the Model 30. The Model 30 utilizes a conically-shaped centrifuge bowl similar to the bowl described in U.S. Pat. No. 4,300,117, FIG. 6, now called the Latham Bowl The bowl is held in a chuck which is attached to a spindle and driven by a motor. The bowl consists of a rotor portion in which blood component is separated and a stator portion consisting of an input and output port. A rotary seal couples the stator to the rotor. One side of the input port is connected through a first peristaltic pump to a source of whole blood from a donor and the other side is in fluid communication with a fractionation volume in the rotor. Anticoagulant is mixed with the whole blood prior to entry into the centrifuge bowl.

The rotor is rotated at a fixed speed and various blood fractions are collected at the output port and directed into appropriate containers by diverting the flow through tubing in accordance with the setting of three-way clamp/switches.

Fractionation within the centrifuge is determined by the relative densities of the different cell components being separated and collected. The various cell fractions pass through the outlet port of the centrifuge bowl by progressive displacement from the lower portion of the bowl.

The bowl consists of a bowl body with an inner cylindrical core coaxial to a central longitudinal axis through the bowl body. The volume between the core and the outer diameter of the bowl body forms a toroidal separation space approximately coaxial to the bowl axis. A rotary seal and header assembly is provided on top of the bowl body and the space between the top of the core and a crown cover over the bowl body forms a collection space. Elongate openings are provided about the core periphery for fluid communication between the separation space and the collection space.

The machine operator is trained to visually observe and assess the boundaries or demarcation lines of different component layers as they approach the elongate peripheral slot core openings into the collection space of the centrifuge bowl. Alternatively, a light detector may be used to sense the line of demarcation.

When the desired fraction has exited the bowl, the centrifuge is stopped. The flow is then reversed and the uncollected cells, such as packed red blood cells (RBC's) are returned to the donor.

Next, another fractionation is made by drawing another supply of anticoagulated whole blood from the donor. Note that during all this time, the same donor is connected to the bowl via tubing. Repeated passes of withdraw and return cycles are made until a desired amount of a desired fraction is achieved.

One of the problems associated with this process is that undesirable cross-contamination of fractions may occur when some of the uncollected cell fraction, to be returned to the donor, is trapped or deposited in the collection space. On the next pass, it is possible for this uncollected fraction to be mixed in with the harvested fraction.

To reduce this possibility, a so-called "splashback" technique has been developed in which some of the first collected light fraction is retained in the tubing between the bowl and collection bag and allowed to return to the collection space to cleanse the space of any remnants or "stains" of heavier fraction that may have been trapped or deposited in the collection space when the centrifuge was braked between the draw and return cycles.

While this "splash-back" technique works reasonably well at removing any stains accumulated in the effluent lines, it is not adequate for removal of stains around the exterior of the header effluent lines and associated guard skirts.

SUMMARY OF THE INVENTION

The invention comprises an improved core for a centrifuge bowl in which the only direct fluid communication passage between the collection space and separation space is provided by a plurality of small circular openings about the upper periphery of the core at the interface between the separation space and the collection space. These small diameter openings slow the drainage of "splash-back" to the separation space, thereby more effectively removing stainage in the collection area than the elongate peripheral slots of the prior art. It also requires less use of "splash back" fluid which is an important consideration, especially when collecting Platelet Rich Plasma (PRP). The highest concentration of platelets is in the last few millimeters of product collected and this, unfortunately, is the part splashed back.

BEST MODE OF CARRYING OUT THE INVENTION

Figures 3, 4, 5, 6, 7:
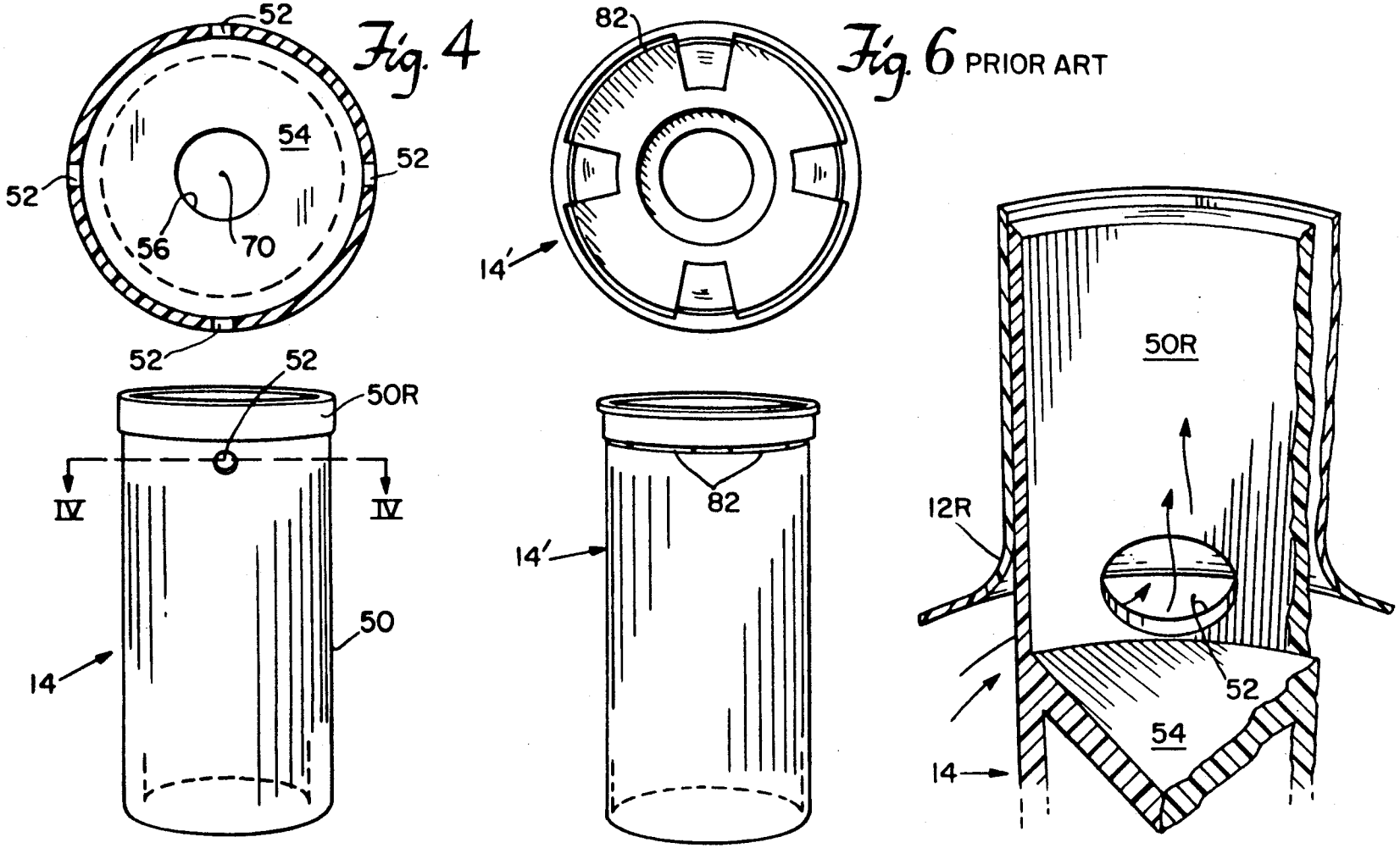
Fig. 6 PRIOR ART
Fig. 5 PRIOR ART
FIG. 3 is a perspective view of a core 14 of FIG. 1.
FIG. 4 is a sectional view along the lines IV—IV of FIG. 3.
FIG. 5 is a perspective view of a prior art core 14'.
FIG. 6 is a top view looking down into the core 14' of FIG. 5.
FIG. 7 is a segmented, enlarged view looking from the interior of collection chamber D of FIG. 3 toward hole 52.

Referring now to FIGS. 1–4, a preferred embodiment of the invention will now be described in connection therewith. As may be seen therein, the apparatus of the invention comprises a disposable centrifuge rotor, or bowl, 10, which is used for processing blood from a patient or donor. The bowl comprises: a seal and header assembly, shown generally at 28 (FIG. 2), a one-piece, seamless, integral bowl body shown generally at 12 (FIG. 1) and a core member 14 (FIGS. 3 and 4).

The seal and header assembly 28 provides a rotary seal and fluid communication pathway between the interior of the rotatable bowl body 12 and stationary conduits 65 and 60 connected respectively to input port 19 and outlet port 20. Assembly 28 is comprised of a stationary header, shown generally at 30, an effluent tube 25, a feed tube assembly, shown generally at 24, and a rotary seal, shown generally at 35 formed of a seal ring 22, and a flexible member 27 and an outside seal member or crown 16.

The header 30 is comprised of an integral formed member having a transverse inlet bore or port 19 extending into an axial longitudinal passageway 19*a* coupled to an inner axially longitudinal bore 61 (of feed tube assembly 24) and, in turn, to feed tube stem 18, thus forming a non-rotating inlet path for anticoagulated whole blood to enter the interior of centrifuge bowl body 12.

Header 30 also includes an outlet port, or bore 20, which extends transversely into a peripheral channel 20*a* extending in coaxial relationship with the feed tube assembly 24 and into an outlet passageway 62. An outer shield member 32 is formed on header 30 and extends over the rotary seal 35.

Feed tube assembly 24 is formed with an integral skirt 24'. A complimentary integral effluent tube skirt 25' is formed on effluent tube 25.

The rotary seal 35, as mentioned above, is formed of a two-piece secondary seal ring which consists of a flexible outside sealing member 27, and ring seal 27. Member 27 is affixed about its outer periphery to the periphery of molded ring sea 22. A seal crown 16 having internal screw threads 16', about the internal periphery thereof, is provided with a central opening 23 through which effluent tube 25 extends. The inner periphery of flexible member 27 is joined to the effluent tube 25.

Figure 2:
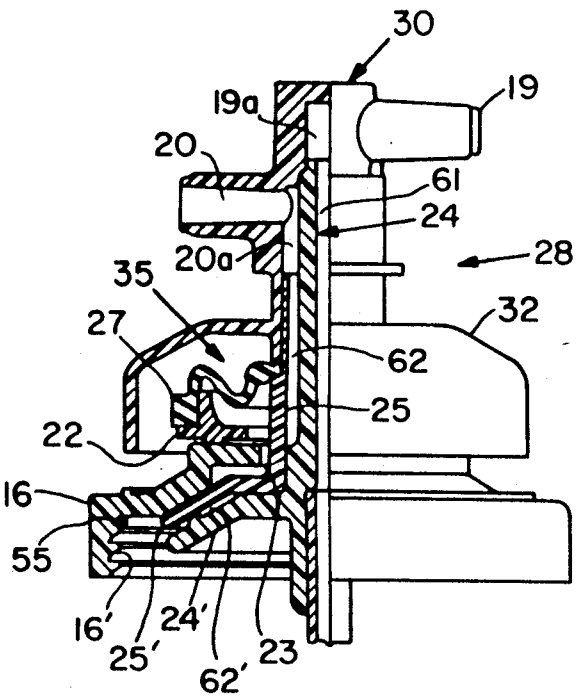
FIG. 2 is a partial cut-away sectional view of the feed tube assembly 28 of FIG. 1.
Figure 1:
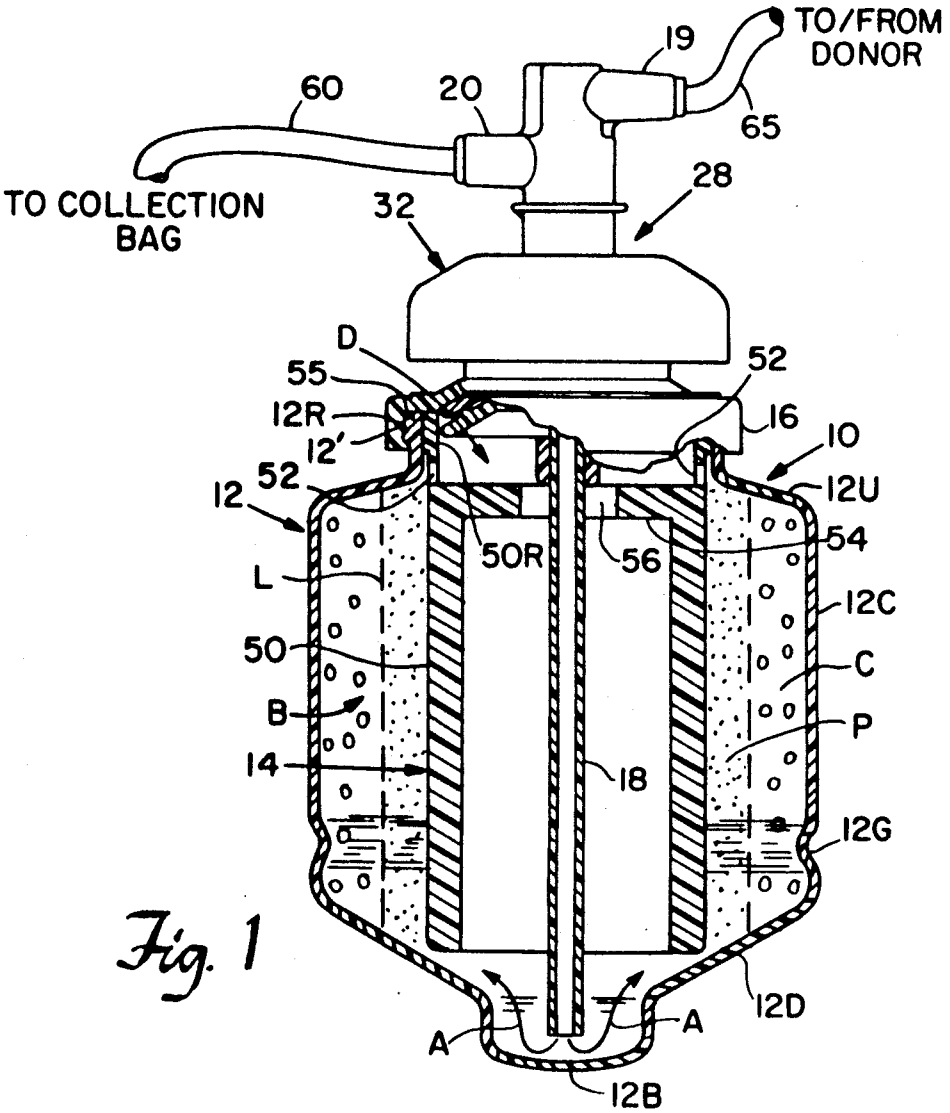
FIG. 1 is a partial cutaway side cross-sectional view of the centrifuge bowl of the present invention.

The header and seal assembly 28, as thus described, is formed and assembled as an individual entity and is inserted through an upper central opening in bowl body 12, as shown in FIG. 1 and mated with external threads 12' formed on the periphery of bowl body 12 after core member 14 has been inserted through said opening and fixed in place within the bowl body 12.

The bowl body 12 is preferably an integral body adapted to be manufactured by blow molding or injection blow molding and may be formed of a suitable plastic, such as transparent styrene or equivalent.

The bowl body is formed of an upper ring portion 12R, an upper diagonal portion 12U, a middle central portion 12C, a lower diagonal portion 12D and a bottom cross portion 12B. Screw threads 12'are formed on the outer surface of ring portion 12R and mate with the inner threads 16' on seal crown 16. An optional groove is formed about the periphery of the bowl at 12G to form a holding surface for a centrifuge rotor chuck (not shown). Alternatively, seal crown 16 may be secured to the bowl body by being crimped thereon.

An O-Ring gasket 55 is disposed on an inner peripheral shoulder of crown member 16 adjacent screw threads 16'. When member 16 is threaded onto bowl body 12, gasket 55 is compressed against the upper wall of ring 12R forming a liquid tight seal.

A cylindrical walled core 14 is adapted to be inserted into the upper opening in bowl body 12 through the opening in ring portion 12R. Core 14 is an integral member having a cylindrical outer wall 50 extending longitudinally and coaxial to the axis of bowl body 12. An upper ring portion 50R of core 14 is adapted to abut the inner wall of the ring portion 12R of bowl body 12 when the core is inserted into the upper opening of the bowl body 12.

A disc-like cross-piece member 54 with a central opening 56 extends transverse the central axis 70 of the body 12 just below openings 52. Four small circular openings 52 are formed at equidistant locations 90 degrees apart about the periphery of the core 14 at the juncture between the ring portion 50R and the cylindrical wall 50, as shown more clearly in FIG. 4 and FIG. 7. These holes 52 provide a passageway for the exit of effluent, such as plasma P, which has been separated from the whole blood by the operation of the centrifuge plasmapheresis process within the bowl body 12.

In order to more clearly understand the important function of the core 14 and, in particular, the holes 52, a typical blood processing protocol will be described generally, as follows:

1. Whole blood is drawn from a patient and anticoagulated and coupled to inlet port 19 via conduit 65. The anticoagulated blood is coupled from inlet port 19 through the longitudinal passageways 19*a* and 61 in feed tube assembly 24 and tube 18 to the bottom portion 12B of the spinning centrifuge bowl 10. The heavier red blood cells are forced radially outwardly from the central axis in the direction of the arrows A and into a separation chamber labelled B, which is formed between wall 12C of bowl body 12 and wall 50 of core 14. The RBC's are retained on the inner bowl wall in the form of a toroidal fraction along the main or central body portion 12C of the bowl, as shown by the cellular shading "C". The lighter, less dense plasma P is captured on the outer surface of cylindrical wall 50 and allowed to exit along the arrows shown in FIG. 7 through the holes 52 at the top wall 50R of core 14 into the collection chamber D formed between the interior upper wall of crown 16 and the cross-member 54. The harvested plasma passes through the channel 62' between skirts 24' and 25' into the passageway 62 and out the outlet port 20 of header 30 to conduit 60 for coupling to a plasma collection bag (not shown).

2. Rotation of the centrifuge bowl 10 is stopped when all the plasma P has passed out the effluent port as detected by observing the progress of the demarcation line L between blood fractions P and C as the line L approaches holes 52.

3. The flow of fluid is then reversed by means of external pumps (not shown) and uncollected cells, such as packed red blood cells (RBC) labelled C are returned to the donor vis conduit 65.

4. After all the RBC's in the bowl body 12 are returned, the process is reversed again, and a second quantity of anticoagulated red blood cells is collected from the same donor for separation into fractions in what is called a second pass. Several passes may be made in order to collect a sufficient quantity of plasma in this fashion.

When making these consecutive passes to separate out fractions of blood component, it is important to prevent or at least minimize cross-contamination of cells. For example, in the collection or harvesting of plasma, it is highly desirable to avoid staining the plasma with RBC's. Staining may occur by deposit of RBC's on the cross-piece 54 or on the interior or exterior of effluent tube 25 and feed tube skirts 25' and 24' when the centrifuge is first braked between passes. Then, on to the next pass, the first plasma to reach these areas rinses the RBC's off the surfaces and sweeps them along into a collection bag (not shown).

Consequently, a protocol has been developed in which a "splash back" of plasma is caused in an attempt to cleanse the areas where the RBC's might be trapped or deposited.

The "splash back" is created in the first part of the return cycle by clamping the effluent line 60 to create a slight vacuum in the bowl 10. When the clamp is removed, plasma in the collection line 60, between the bowl 10 and collection bag, rushes back into the bowl 10 and rinses the trapped or deposited RBC's back into the separation chamber B of the bowl body 12 so it is not carried out the effluent line 60 as new plasma P is first collected in the next pass.

In contrast, current core bodies 14' (See "prior art" FIGS. 5 and 6) use relatively large elongate slots 82 to communicate between the collection chamber and the separation or chamber. Such large slots were thought to be necessary to avoid restriction of plasma flow from the separation chamber to the collection chamber.

Such large slots unfortunately also allow the "splash back" plasma to flow virtually unimpeded in the reverse direction from the collection chamber to the separation chamber. This renders the "splash back" washing technique less effectual, especially around the areas of the outside of the effluent tube 25 and feed tube skirts 25',24'.

In accordance with the present invention, the wide peripheral slots 82 of the prior art are replaced by a few small (preferably, about 0.16 inch diameter but possibly less) holes 52 located at 90 degree intervals around the periphery of the core 14 and located at the bottom of the collection chamber. In addition, the cylindrical core outer diameter is widened such that the openings 52 are close to the bowl body surface 12R causing the "splash back" to impinge on this surface before flowing downward into the separation chamber B; thus, further impeding the flow back. These small holes 52 and their locations provide sufficient fluid communication from the separation chamber B to the collection chamber D; yet have the distinct advantage of providing restricted flow of plasma "splash back".

This restriction can be thought of as making a smaller drain from the collection chamber D to the separation chamber B. This causes the plasma being "splashed back" to back up and wash around the outside of the effluent tube 25 and feed tube skirts 24',25' and around the entire collection chamber D before draining out into the separation chamber B. This improved "stain" washing reduces the amount of RBC's remaining in the collection area of the bowl to contaminate the plasma collected at the beginning of the next pass.

The improved small communication openings have also been found to reduce the transmission of turbulence from the collection chamber D back to the separation chamber B, further reducing the probability of cross-contamination which could result from turbulent forces.

EQUIVALENTS

Those skilled in the art will recognize that there are many equivalents to the specific embodiments described herein. Such equivalents are intended to be encompassed within the scope of the following claims. For example, while the invention has been described principally in connection with a plasmapheresis process in which plasma is used for "splash back", other fractionation processes may involve use of other "splash back" fluids. Also, the process may be used in connection with cell washing systems in which saline is used for a "splash back" fluid.

I claim:

1. A centrifuge rotor for processing blood components comprising:

a) a bowl body adapted for rotation about an axis and having a single aperture therein through an outer wall of the bowl body; and b) a rotary seal assembly affixed to said bowl body and covering said aperture;

c) a cylindrical core with a first portion extending in one direction into said bowl body and forming a separation chamber between said core and said bowl body and a second portion extending in an opposite direction;

d) an upper wall member extending across said core transverse said axis between said first and second portion with the space between said wall member on one side and said seal assembly on another side forming a collection chamber enclosed on the periphery of said second portion;

e) a plurality of small openings extending through said core, each of said openings having a line extending symmetrically through a center of said opening, said line extending laterally through said second portion transverse said axis of rotation and said openings forming a path for fluid communication between said collection chamber and said separation chamber.

2. The rotor of claim 1 wherein the size of said openings is greater than zero and about 0.16 inches in diameter or less.

3. The rotor of claim 2 wherein said openings are four in number and are formed equidistant about the periphery of the core.

4. The rotor of claim 1 wherein the rotary seal is provided with a threaded crown which is screwed onto complementary threads on the bowl body to cover the aperture.

5. The rotor of claim 4 wherein an O-ring is disposed between the seal and bowl body about the periphery of the aperture.

6. The rotor of claim 1 for use in processing blood components wherein the cylindrical wall of the core extends along the length of the bowl.

7. The rotor of claim 1 wherein the rotary seal assembly includes a rotary portion and a fixed portion with an inlet tube and an outlet tube extending through the seal and in fluid communication with the inside of the bowl body.

8. A centrifuge rotor for separation of blood components by centrifugation comprising:

a) a bowl body adapted for rotation about its longitudinal axis and having a single closeable aperture concentric with said axis at one end thereof;

b) a rotary seal assembly having a cover for sealing said seal assembly to the outer body wall about the periphery of said aperture; and c) a core member with a cylindrical wall extending within said bowl in one direction from said aperture concentric about said axis and an upper portion of the wall extending in an opposite direction and a transverse member extending across the upper portion of said wall with a collection chamber formed between the cover and the transverse member and the upper portion of the cylindrical wall and the lateral space between the periphery of the core member and the bowl body forming a separation chamber and small circular openings extending through said core, each of said openings having a line extending symmetrically through a center of opening, said line; extending transverse said longitudinal axis, said openings located in the upper portion of the cylindrical wall of the core located about the periphery thereof for providing direction fluid communication between the two chambers and for washing blood component remaining in the collection chamber back into the separation chamber.

9. The rotor of claim 8 wherein the diameter of the openings is greater than zero and about 0.16 inches or less and there are four openings spaced 90 degrees apart about the periphery of the core member.

10. A centrifuge blood processing rotor for sequentially separating lighter, less dense fluid blood constituents from heavier more dense fluid constituents comprising:

a) a bowl body adapted for rotation about its longitudinal axis and having a single aperture concentric with said axis at one end of the outer wall of the bowl body;

b) a rotary seal assembly affixed to the outer wall about the periphery of said aperture and having an effluent port and input pot in fluid communication with the interior of said bowl body; and (c) a core member having a cylindrical wall concentric with said axis and extending within said aperture and a first portion of said wall extending into said bowl body and a second portion of said wall extending toward said seal assembly with an apertured wall extending transverse the longitudinal axis between the first and second portions and openings formed about the periphery of said second portion, each of said openings extending through said core and having a line extending symmetrically through a center of said opening, said line extending transverse said longitudinal axis, said openings permitting exit of separated blood constituents from said bowl body to said effluent port through said openings and restrictive return of lighter, less dense fluid from said effluent port to said bowl body to wash back any heavier, more dense fluid prior to another separation sequence thereby to prevent staining of separated blood constituents.

* * * * *